US006366757B1

(12) United States Patent
Tsujimoto et al.

(10) Patent No.: US 6,366,757 B1
(45) Date of Patent: Apr. 2, 2002

(54) INDUCTION HEATING FIXING DEVICE

(75) Inventors: Takahiro Tsujimoto; Yukinobu Iguchi, both of Toyokawa (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/670,518

(22) Filed: Sep. 26, 2000

(30) Foreign Application Priority Data

Sep. 29, 1999 (JP) ..... 11-276406

(51) Int. Cl.[7] ..... G03G 15/20
(52) U.S. Cl. ..... 399/329; 399/335
(58) Field of Search ..... 399/328, 329, 399/330, 331; 219/216

(56) References Cited

U.S. PATENT DOCUMENTS 5,506,666 A * 4/1996 Masuda et al. ..... 399/335
5,568,235 A * 10/1996 Amarakoon ..... 399/319
5,752,148 A * 5/1998 Yoneda et al. ..... 399/329
6,069,347 A * 5/2000 Genji et al. ..... 399/330 X
6,154,629 A * 11/2000 Kinochi et al. ..... 399/329
6,188,054 B1 * 2/2001 Ohta ..... 399/330 X

FOREIGN PATENT DOCUMENTS

| | | | |
|---|---|---|---|
| JP | 8-0006408 | * | 1/1996 |
| JP | 9-244440 | * | 9/1997 |
| JP | 10-207265 | | 8/1998 |
| JP | 10-207271 | * | 8/1998 |
| JP | 11-238576 | * | 8/1999 |

* cited by examiner

*Primary Examiner*—Fred L Braun
(74) *Attorney, Agent, or Firm*—McDermott, Will & Emery

(57) ABSTRACT

An induction heating fixing device transports a sheet sandwiched between a fixing belt and a pressing roller pressed thereagainst, heats the sheet, and thereby fixes a toner image onto the sheet. The fixing belt is composed of a conductive member, a core, and an induction coil which have been formed into thin films and stacked in layers so that the size and weight of the fixing device are reduced.

6 Claims, 3 Drawing Sheets

INDUCTION HEATING FIXING DEVICE

BACKGROUND OF THE INVENTION

1. Field of the Invention

The present invention relates to a fixing device for use in an electrophotographic image forming apparatus such as a copier, a printer, or a facsimile and, more particularly, to a fixing device for fixing a toner image to a recording medium by utilizing low-frequency induction heating.

2. Description of the Related Art

An electrophotographic image forming apparatus such as a copier, a printer, or a facsimile is provided with a fixing device for fixing a toner image formed on a sheet as a recording medium to the sheet.

Although various systems have been used to implement the fixing device, there has been proposed a fixing device in an induction heating system to satisfy the recent request for energy conservation. The system is more efficient than a fixing system using a halogen lamp as a heat source which has been currently in widespread use.

As disclosed in, e.g., Japanese Unexamined Patent Publication No. Hei 10-207265, a fixing device in an induction heating system comprises: a hollow conductive member; a iron core partly inserted through the hollow conductive member to form a closed magnetic circuit; and an induction coil wound around the iron core. By allowing an alternating current to flow through the induction coil, an induction current is generated in the hollow conductive member, thereby inductively heating the hollow conductive member.

Such a fixing device in an induction heating system is internally provided with a iron core which forms a closed magnetic circuit. The mounting of the iron core requires an installation capacity and causes the problem of a larger-sized device.

In addition, the iron core is heavier in weight than a halogen lamp or the like. Therefore, a member for holding the iron core should have sufficient rigidity to withstand the heavy weight, which leads to higher cost.

In a structure in which the conductive member is formed on a roller, the roller has a large diameter to conform to the cross-sectional area of the iron core. This increases a curvature on a surface of the roller so that the sheet after fixation is less likely to be separated from the surface of the roller.

OBJECTS AND SUMMARY

In view of the foregoing circumstances, it is therefore an object of the present invention to provide an improved induction heating fixing device.

Another object of the present invention is to reduce the size and weight of the induction heating fixing device by providing a smaller-sized closed magnetic circuit iron core.

Still another object of the present invention is to provide an induction heating fixing apparatus which allows smooth discharge of a sheet after fixation and is less likely to suffer a sheet jam.

To attain the above and other objects, an induction heating fixing device in accordance with an aspect of the present invention comprises: a conductive member; a core forming a closed magnetic circuit; and an induction coil provided around the core to generate an induction current in the conductive member. The conductive member, core, and induction coil are formed in stacked thin layers. This reduces the size and weight of the entire fixing device. Since the weight of the fixing device itself is reduced, it is no more necessary to use such a member with high rigidity as used in the conventional induction heating fixing device, which offers a cost advantage.

The conductive member, core, and induction coil stacked in layers are formed as an endless flexible belt. As a consequence, the sheet after fixation can be separated from a surface of the belt more successively than in a fixing device in a roller system.

BRIEF DESCRIPTION OF THE DRAWINGS

These and other objects and features of the present invention will become apparent from the following description of a preferred embodiment thereof taken in conjunction with the accompanying drawings, in which.

In the following description, like parts are designated by like reference numbers throughout the several drawing.

DETAILED DESCRIPTION OF THE PREFERRED EMBODIMENTS

Figure 1:
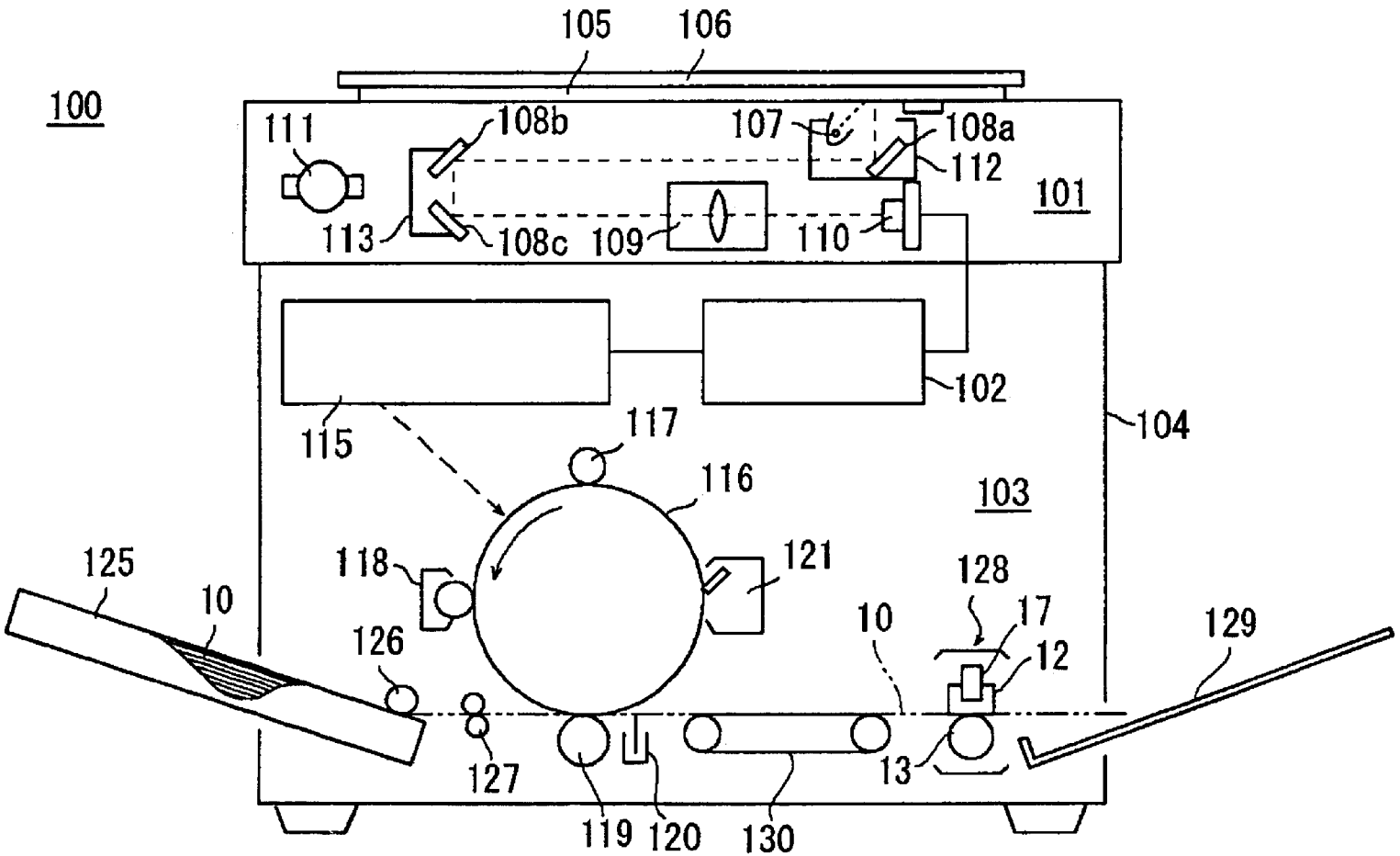
FIG. 1 is a schematic view of a copier comprising an induction heating fixing device.

Referring now to the drawings, the embodiments of the present invention will be described.

FIG. 1 is a schematic view showing a structure of a copier comprising an induction heating fixing device.

As shown in the drawing, a copier 100 comprises: an image scanner 101 for reading an original and generating an image signal; a signal processing unit 102 for processing an image generated by the scanner 101; a printer 103 for printing, onto a sheet 10, an image corresponding to an original image based on the image signal processed by the signal processing unit 102; and a casing 104 for accommodating the foregoing components.

In the image scanner 101, the original is placed on a platen glass 105 with an image surface facing downward. The placed original is pressed by a platen cover 106 for registration. The original on the platen glass 105 is illuminated with light from a lamp 107. The light reflected by the original passes through mirrors 108*a*, 108*b*, and 108*c* and a condenser lens 109 to be projected on a CCD line image sensor 110. The CCD line sensor 110 converts the original image projected thereon to an image signal and transmits the image signal to the signal processing unit 102. First and second sliders 112 and 113 are driven by a scanner motor 111 to move along the platen glass 105. That is, the sliders 112 and 113 move in a direction (sub-scanning direction) orthogonal to the direction (main scanning direction) in which the pixels of the line image sensor 110 are arranged, whereby the entire surface of the original is scanned. At this time, the first slider 112 moves at a velocity v and the second slider 113 moves at a velocity v/2.

The signal processing unit 102 electrically processes the image signal read by the line sensor 110 and transmits the processed image signal to the printer 103.

The printer 103 comprises: a laser generator 115; and a photosensitive drum 116. Around the photosensitive drum 116 rotating are successively disposed: a charging roller 117;

a developing device 118; a transfer roller 119; a destaticizing needle 120; and a cleaning device 121. The charging roller 117 uniformly charges a surface of the photosensitive drum 116 to a specified potential. The laser generator 115 drives and modulates a semiconductor laser in accordance with the level of the image signal sent from the signal processing unit 102. Laser light passes through a polygon mirror, a f-θ lens, a return mirror, and the like, which are not depicted, to expose the surface of the photosensitive drum 116 charged by the charging roller 117, whereby an electrostatic latent image is formed on the photosensitive drum 116. The electrostatic latent image is developed with a toner by the developing device 118.

On the other hand, the plurality of sheets 10 are held in layers in a paper feed cassette 125 removably attached to the casing 104. The sheets 10 in the paper feed cassette 125 are parted one after another to be fed by a sheet feed roller 126. The fed sheet 10 is sent with a given timing by a timing roller 127 toward a transfer position between the photosensitive drum 116 and the transfer roller 119. A toner image developed on the photosensitive drum 116 is transferred onto the sheet 10 by the transfer roller 119. The sheet 10 after transfer is separated from the photosensitive drum 116 and transported by a transport belt 130 toward a fixing device 128. An unfixed toner image transferred onto the sheet 10 is melted in the fixing device 128, solidified thereafter, and thereby fixed on the sheet 10. The sheet 10 having the toner image fixed thereon is discharged into a discharge tray 129.

When the transfer to the sheet 10 by the transfer roller 119 is completed, a residual toner is removed from the surface of the photosensitive drum 116 by the cleaning device 121. Thereafter, the surface of the photosensitive drum 116 is charged again by the charging roller 117 such that the foregoing process is repeated.

Figure 2:
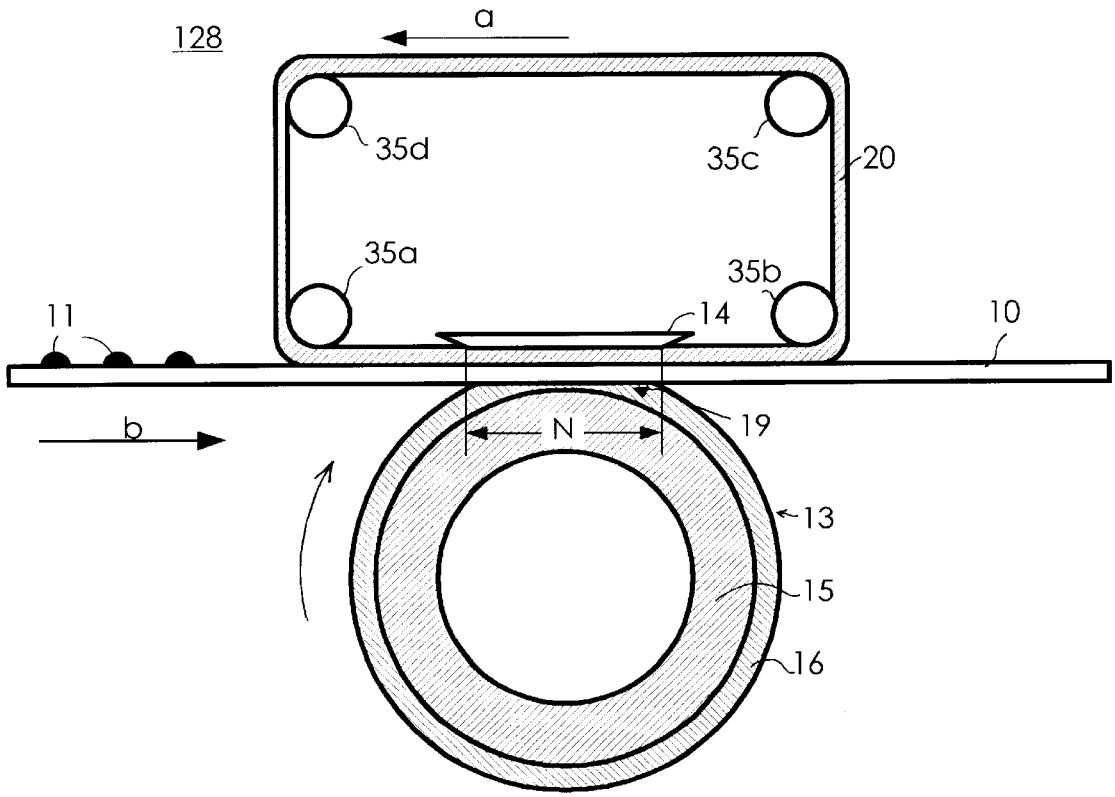
FIG. 2 is a cross-sectional view of the induction heating fixing device in a plane along the direction of sheet transportation.

FIG. 2 is a cross-sectional view showing a principal portion of the induction heating fixing device 128.

As shown in the drawing, the fixing belt 20 formed in an endless configuration is entrained around four rotatable rollers 35 and supported to be circulated along a rectangular path connecting the four rollers 35*a*, 35*b*, 35*c*, and 35*d*. A pressing roller 13 is disposed under the fixing belt 20. At a position inside the circulating path of the fixing roller 20 and in opposing relation to the pressing roller 13 there is disposed a backup member 14 which presses the fixing belt 20 from the rear surface thereof against the pressing roller 13. This brings the fixing belt 20 into close contact with the pressing roller 13 by the width N of the backup member 14. Hereinafter, the position at which the fixing belt 20 is in contact with the pressing roller 13 by the width N is referred to as a nip.

The pressing roller 13 is rotatively driven by a motor in the clockwise direction indicated by the arrow in the drawing. The fixing belt 20 moves in the direction indicated by the arrow a with the rotative driving of the pressing roller 13.

The pressing roller 13 is composed of an axial core 15 and a silicon rubber layer 16 formed around the axial core 15. The silicon rubber layer 16 is a rubber layer having mold release properties which allow easy separation of the sheet 10 from the surface thereof and having heat resistance. The pressing roller 13 is pressed by a spring member not shown in a direction toward the fixing belt 20.

Figure 3:
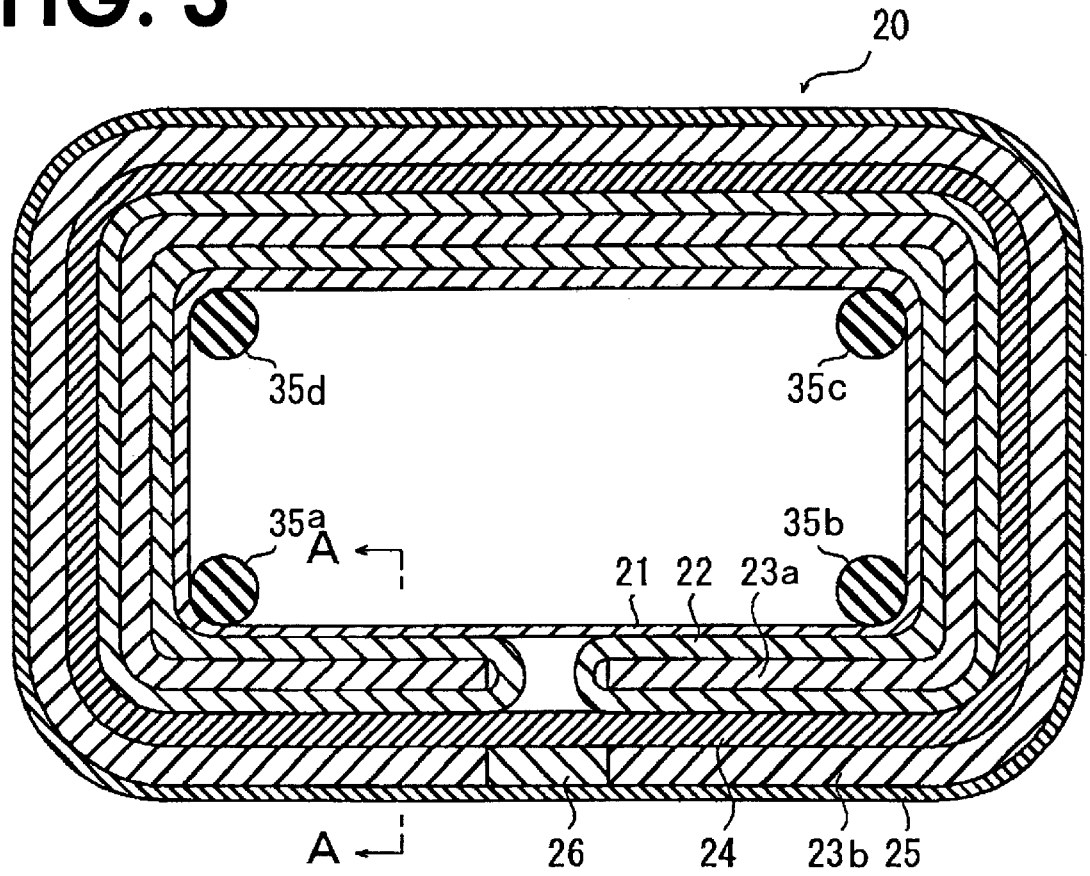
FIG. 3 is a cross-sectional view of a fixing belt in the plane along the direction of sheet transportation.
Figure 4:
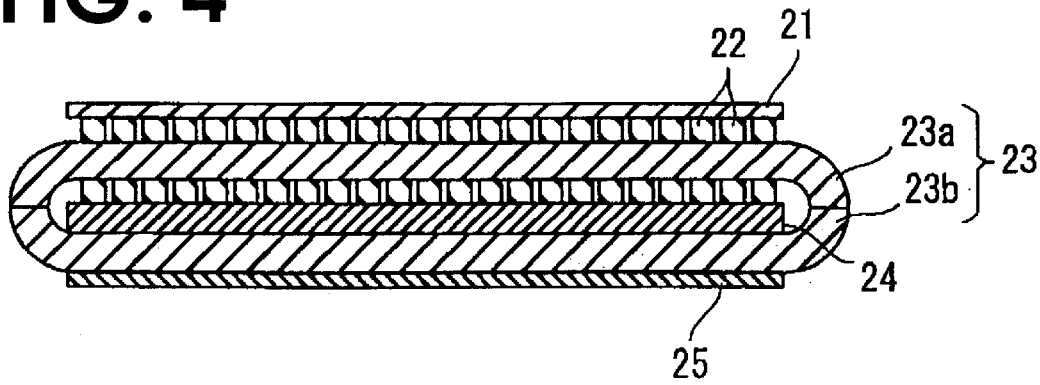
FIG. 4 is a cross-sectional view of the fixing belt in a plane orthogonal to the direction of sheet transportation.

FIG. 3 is a cross-sectional view for illustrating a structure of the fixing belt 20. FIG. 4 is a cross-sectional view taken along the line A—A in FIG. 3.

The fixing belt 20 is obtained by forming, around a core 23*a*, a coil 22 wound in a direction coincident with the circulation path of the belt and providing a temperature raising member 24 around the outer circumference of the coil 22. The core 23*a* has both ends connected to a core 23*b* (see FIG. 4). As a consequence, the cores 23*a* and 23*b* combine to form a closed magnetic circuit intersecting the direction in which the coil 22 is wound.

Each of the coil 22, core 23, and temperature raising member 24 is formed in a thin film and has flexibility. The coil 22 is internally provided with a base material 21 for supporting each of the thin-film members and has a mold release layer 25 provided on the outer circumference thereof, which is for improved mold release properties between the coil 22 and the sheet.

By nature, the core 23 is preferably composed of a material with high magnetic permeability such as a silicon steel plate. However, an iron material containing a silicon component in a low proportion (or containing no silicon component) is used here in the form of a thin film to have flexibility. Besides, a material such as SUS (magnetic material) may also be used in the form of a thin film.

The temperature raising member 24 may be composed appropriately of a conductive member made of stainless steel or aluminum. The member is formed into a thin film for use.

To compose the base member 21, stainless steel, aluminum, or the like is used in consideration of heat resistance and durability, similarly to, e.g., the temperature raising member. This causes induction heating also in the base member and improves heat generating efficiency.

The mold release layer 25 is obtained by coating a silicon rubber on the outermost surface of the core 23.

Such a fixing belt 20 is fabricated by initially vapor-depositing a copper thin film on an iron material in the form of a flat thin film which is used as a core 23*a* (see FIG. 4) with an insulating film (not shown) interposed therebetween and then patterning the copper thin film into a coil configuration. Thereafter, the temperature raising member 24 is laminated via an insulating film (not shown). Further, a thin-film iron material as the core 23*b* portion is laminated on the outside of the temperature raising member 24 to have both end portions connected to the core portion 23*a*. Thereafter, the base material 21 and the mold release layer 25 are stacked and connected in an endless configuration, as shown in FIG. 3, and a resin 26 is filled in the space of a connecting portion.

The operation of the fixing device 128 is such that, if an alternating power of 50 to 60 Hz is applied first from a power source circuit (not shown), a magnetic flux is generated in the core 23. As a consequence, an induction current is produced in the temperature raising member 24 to cause heat generation. The fixing belt 20 is raised in temperature by such low-frequency induction heating till a temperature appropriate for fixation (e.g., 150 to 200° C.) is reached. The temperature of the fixing belt 20 is raised till a temperature suitable for fixation (e.g., 150 to 200° C.) is reached.

The sheet 10 holding the unfixed toner 11 is transported in the direction indicated by the arrow b in FIG. 2 and sent toward the nip 19 which is the contact portion between the fixing belt 20 and the pressing roller 13. The sheet 10 is held in a sandwiching manner at the nip 19 and transported by the rotative driving of the pressing roller 13, while heat from the heated fixing belt 20 and pressure exerted by the pressing roller 13 are applied to the sheet 10. As a result, the unfixed toner 11 is melted on the sheet 10, solidified thereafter, and fixed on the sheet 10. The sheet 10 that has passed through the nip 19 is naturally separated from the fixing roller 20 due to the nerve of the sheet 10 and transported in the right direction in FIG. 2. After fixation, the sheet 10 is transported by the discharge roller and discharged into the discharge tray 129.

The fixing belt 20 is supported by the rollers 35*a* and 35*b* to be flat along the sheet transport path and come into contact with the pressing roller 13 at the flat portion. Accordingly, the nip 19 may have the large width N and the sheet 10 held at the nip 19 in a sandwiching manner can be heated sufficiently. The fixing belt 20 is elevated at generally right angles by the roller 35*c* at the position of the roller 35*b* immediately after the nip 19. As a consequence, the sheet 10 transported to the position of the roller 35*b* after passing through the nip 19 is separated successively from the fixing belt 20 due to the nerve of the sheet 10 itself to move straight forward.

The principle of operation of the induction heating fixing device is the same as that of a transformer so that the coil 22 corresponds to a primary coil (N turns) on the input side and the temperature raising member 24 corresponds to a secondary coil (1 turn) on the output side. If an alternating voltage V1 is applied to the primary coil (coil 22), a current I1 flows in the primary coil to generate a magnetic flux $\phi$, which flows into the core 23 forming the closed magnetic circuit to generate an induction electromotive force V2 in the secondary coil (temperature raising member 24), so that a current 12 flows in the temperature raising member 24 in a direction crossing the direction of the magnetic flux. Since the closed magnetic circuit has been formed by the core 23, principally no leakage flux exists so that a primary energy V1×I1 and a secondary energy V2×I2 become nearly equal to each other.

Heat generation occurs at three portions in the system in which induction heating is performed. The first portion is the primary coil which generates heat due to a copper loss in the copper wire of the primary coil, i.e., heat is generated from the coil 22 itself. The second portion is the secondary coil which generates heat due to a copper loss in the copper wire of the secondary coil, i.e., heat is generated by induction heating by the temperature raising member 24. The third portion is the core 23 which generates heat due to a Joule heat loss and a hysteresis loss produced inside the core. Since heat generation occurring at the first and third portions leads to an energy loss, the induction heating fixing device minimizes the heat generation at these portions, while causing the temperature raising member 24 to generate heat by utilizing the copper loss at the second portion.

In accordance with the principle of heat generation, the present fixing device is capable of performing remarkably efficient induction heating since the coil 22 and the core 23 and the core 23 and the temperature raising member 24 are in contact with each other via the respective thin insulating films. Since the fixing belt 20 is formed as a flexible thin film, it is no more necessary to use a heavy iron core that has been used conventionally so that a fixing device reduced in size and weight is provided.

Although the present invention has been fully described by way of examples with reference to the accompanying drawings, it is to be noted that various changes and modifications will be apparent to those skilled in the art. Therefore, unless such changes and modification depart from the scope of the present invention, they should be construed as being included therein.

What is claimed is:

1. An induction heating fixing apparatus, comprising:

a fixing member having a conductive member, a core forming a closed magnetic circuit, and an induction coil provided around the core to generate an induction current in the conductive member, wherein said conductive member, core, and induction coil are formed in stacked thin film layers; and a pressing member which is pressed toward the fixing member.

2. The induction heating fixing apparatus as claimed in claim 1, wherein the fixing member is formed as an endless flexible belt.

3. The induction heating fixing apparatus as claimed in claim 2, wherein the fixing member formed as an endless flexible belt, is entrained around rollers and supported to be circulatable along a path connecting the rollers.

4. The induction heating fixing apparatus as claimed in claim 3, wherein the pressing member is arranged against said endless flexible belt.

5. The induction heating fixing apparatus as claimed in claim 3, further comprising a backup member which presses the endless flexible belt from a rear surface thereof against said pressing member at a circulation path of the endless flexible belt and in opposing relation to the pressing member.

6. An endless flexible belt for use in an induction heating fixing apparatus of an image forming apparatus, said endless flexible belt comprising:

a conductive member;

a core forming a closed magnetic circuit; and an induction coil provided around the core to generate an induction current in the conductive member, wherein said conductive member, core, and induction coil are formed in stacked thin layers.

* * * * *